US005297415A

United States Patent [19]

Hendricks

[11] Patent Number: 5,297,415

[45] Date of Patent: Mar. 29, 1994

[54] METHOD FOR FORMING TUBING INTO CURVED, UNBALANCED AND NON-UNIFORM SHAPES

[75] Inventor: John L. Hendricks, Grand Rapids, Mich.

[73] Assignee: Steelcase Inc., Grand Rapids, Mich.

[21] Appl. No.: 830,925

[22] Filed: Feb. 4, 1992

Related U.S. Application Data

[63] Continuation of Ser. No. 645,971, Jan. 24, 1991, abandoned.

[51] Int. Cl.[5] ..... B21D 7/00

[52] U.S. Cl. ..... 72/369; 72/306; 72/702

[58] Field of Search ..... 72/369, 370, 367, 306, 72/217-219, 152, 206, 168, 702; 29/890.053, 890.01, 890.149; 297/418, 411; 138/DIG. 11

[56] References Cited

U.S. PATENT DOCUMENTS

| | | | |
|---|---|---|---|
| Re. 19,927 | 4/1936 | Johnson . | |
| 1,534,314 | 4/1925 | Heintz | 72/369 |
| 1,696,251 | 12/1928 | Penney . | |
| 1,721,964 | 7/1929 | McAleenan . | |
| 2,044,322 | 6/1936 | Oliver et al. . | |
| 2,234,677 | 3/1941 | Larsen | 297/418 |
| 2,285,275 | 6/1942 | Harder | 72/369 |
| 2,296,451 | 9/1942 | Roberts | 72/369 |
| 2,654,942 | 10/1953 | May . | |
| 2,746,727 | 5/1956 | Earl | 29/890.053 |
| 2,748,455 | 6/1956 | Draper | 72/415 |
| 3,152,836 | 10/1964 | Swan | 297/418 |
| 3,810,302 | 5/1974 | Broers | 72/369 |
| 3,821,525 | 6/1974 | Eaton et al. . | |
| 3,869,776 | 3/1975 | Moshnin | 72/369 |
| 3,964,289 | 6/1976 | Williamson, Jr. . | |
| 4,031,745 | 6/1977 | McCarty | 72/367 |
| 4,373,371 | 2/1983 | Liu . | |
| 4,527,411 | 7/1985 | Shinosaki | 29/890.053 |
| 4,854,150 | 8/1989 | Brown et al. . | |
| 5,094,096 | 3/1992 | Sheckells | 72/369 |

FOREIGN PATENT DOCUMENTS

| | | | |
|---|---|---|---|
| 626852 | 9/1961 | Canada | 29/897.2 |
| 150631 | 8/1984 | Japan | 29/890.053 |
| 531600 | 10/1976 | U.S.S.R. | 72/369 |
| 691227 | 10/1979 | U.S.S.R. | 72/369 |

*Primary Examiner*—Daniel C. Crane
*Attorney, Agent, or Firm*—Price, Heneveld, Cooper, DeWitt & Litton

[57] ABSTRACT

A method and apparatus for forming a length of tubing into a curved, unbalanced and non-uniform shape continuously bends the tubing and then changes the cross-sectional shape along the length of the tubing to eliminate springback and provide a stable part with shape retention The apparatus includes relatively movable upper and lower half die shoes A form post, a forming steel subassembly, a plurality of slides and driver posts are positioned on the shoes in juxtaposed relationship. A clamp holds a length of tubing against the form post. Movement of the die shoes towards each other shifts the slides to continuously bend the tube about the form post. After the bending operation, the cross-sectional shape of the tubing is changed from a generally circular shape towards an oval or generally rectangular shape. A pressure is applied to induce stresses which eliminate springback and provide a stable part.

7 Claims, 11 Drawing Sheets

METHOD FOR FORMING TUBING INTO CURVED, UNBALANCED AND NON-UNIFORM SHAPES

CROSS REFERENCE TO RELATED APPLICATION

This is a continuation of copending application Ser. No. 07/645,971 filed Jan. 24, 1991, now abandoned.

BACKGROUND OF THE INVENTION

The present invention relates to a method and apparatus for creating complex, unbalanced and non-uniform shaped structures.

A wide variety of products in the office furniture industry are presently manufactured which can be described as having complex, unbalanced and non-uniform shapes. Chairs, tables and the like employ parts with shapes dictated, in part, by structural as well as aesthetic and ornamental considerations incorporated into the article by the designer. Chair arms, for example, must have sufficient strength to provide adequate arm support. The arms also perform an ornamental function and, hence, may have a complex, non-uniform shape.

Heretofore, complexly configured structures have been manufactured using a variety of techniques. The parts may be cast from metal or molded from engineering plastics. Casting techniques suffer from inherent problems related to cost, material waste, labor and quality control. Porosity and material shrinkage, for example, may result in shape changes, surface defects and the like. Generally, complexly configured cast articles must have additional machining operations performed on them so that the desired shape and tolerances are obtained.

In many instances, configured structural parts such as automotive framing and chair components may be formed by welding together sheet metal stamped parts. The resulting structures have a closed, looped configuration in cross-section and provide the needed strength without many of the disadvantages of casting processes. Welding of the stamped parts can, however, cause heat warpage and shape changes. Weld splatter can have an adverse effect on surface finish. In addition, blanking and trimming operations associated with stamped parts result in significant process scrap.

The use of tubing having a closed loop cross-section which may be circular, oval or rectangular to form structural parts has been proposed. Tubing can be bent, flared, swedged, drawn and sized and, hence, formed into a wide variety of shaped parts. The specific shapes and areas where tubing could be used have been inherently limited, however, by known manufacturing processes. Formation of tubing into various shapes through bending operations may be limited by shape changes caused by uncontrolled weld seam location, heat distortion caused during welding operations and material springback. Springback, that is, the elastic recovery of the material from which the part is made, causes the shaped part to move back toward an original prebent configuration.

Various processes have been proposed to form parts or to bend tubing to compensate for such springback and material deformation. An example of one such method and apparatus may be found in U.S. Pat. No. 3,821,525 entitled METHOD AND APPARATUS FOR AUTOMATICALLY COMPENSATED TUBE BENDING and which issued on Jun. 28, 1974, to Eaton et al. As set forth therein, in order to bend a tube to a desired bend angle, it was necessary to "overbend" the tube initially so that, when released, it would spring back to the desired bend angle. Springback makes maintenance of required tolerances and the part configuration extremely difficult. Normal tube bending processes required incremental steps or stages and required the tube or bending tools to be moved during the forming process. Portions of the tube between bend points tended to return to original straight conditions. In order to compensate for springback, a machine is disclosed in the aforementioned patent which includes a carriage assembly having a rotating collet chuck for selectively gripping the end of a length of tubing. The tube is longitudinally moved with respect to a bend die. The tube is moved to the desired position by the carriage and a clamp die and bent. A wiper die and pressure die grip a portion of the tube behind the bend to provide controlled elongation of the tube around the bend. An automatic controller or computer and sensors indicate the position of the bend die, carriage and collet chuck. The controller generates operating commands and receives inputs from conventional sources. The system attempts to predetermine the proper degree of overbend and fixed and radial compensation to provide a tube having a desired shape.

An example of another method and apparatus is disclosed in U.S. Pat. No. 4,854,150 entitled METHOD OF BENDING AND FORMING HEATED TUBULAR WORKPIECES and issued on Aug. 8, 1989 to Brown et al. The method and apparatus disclosed therein forms a tube into a desired shape through controlled heating, forging and bending followed by quenching. The process results in a permanent form. A tubular bar or workpiece is heated and held against a forming anvil by clamping structure. The heated tubular bar is bent by a plurality of forming rollers around the anvils. An hydraulic system and a plurality of actuators control the positioning of the forming rollers. Heating and quenching steps are used for configuration stability.

A need exists for a method and apparatus which is capable of forming or creating complex, unbalanced and non-uniform shaped structures from tubing in an efficient, cost effective manner and which results in stable parts having complete shape retention, acceptable tolerances and no memory or springback.

SUMMARY OF THE INVENTION

In accordance with the present invention, the aforementioned need is fulfilled. Essentially, an apparatus and a method are provided which forms a length of tubing having a closed loop cross-section into a complex curved shape by bending at least a portion of the length of tubing on a continuous basis to achieve a desired shape and then changing the cross-section of the tubing along its length to eliminate springback and provide a stable part with shape retention through pressure-stress forming. Contrary to the express teachings of the prior art, overbending, heat treating and the like are not needed to achieve a desired part shape. Closer tolerances can be maintained.

The apparatus includes a lower half die subassembly supporting a form post, a clamp subassembly and a plurality of slides. An upper half die subassembly supports a plurality of driver posts which engage the lower slides and move them towards the form post. In addition, the upper half die subassembly includes a forming steel or member which cooperates with the form post to configure the tubing.

A tube is moved into position and held against the form post by the clamp subassembly. As the die subassemblies move towards each other, the driver posts engage the slides and the tubing is continuously bent around the form post. After the tubing is bent to the desired shape and while it is in contact with the form post and forming steel, the slides are shifted further and the tubing is deformed in cross-section. The deformation is achieved by applying pressure sufficient to set up stresses in the tubing which counterbalance surface stresses to eliminate springback caused by the elasticity of the metal. The tube cross section is forced into a rectangular space.

The method and apparatus in accordance with the present invention provide stable parts with complete shape retention. Complex, unbalanced and non-uniform shaped structures may be quickly and efficiently formed from straight tubes. The resulting parts have no shape memory or springback. The weld seam location of the tubing need not be controlled to prevent shape changes. The formed tubing provides the structural requirements for the part as well as the aesthetics required for a complex shaped part.

The forming process is completed in a continuous cycle and is adaptable to form many configured parts without material or process scrap. The configuration of the tubing is achieved more through a shaping process than bending or end forming process. The pressures required to eliminate springback vary based more upon the shape being formed than on the physical characteristics of the tubing itself such as initial diameter, tensile strength or other physical properties. A principal limitation, however, relates to the relationship between tube initial diameter and the radius of any bend form. If the radius is too small, the tubing will kink resulting in wall to wall contact.

The method and apparatus may be used to form many different configured parts such as those found in the furniture and automotive industries. The invention could be used to form a structural frame for a door or trunk lid. The frame may be molded with a plastic which provides part aesthetics. Many applications are possible.

DETAILED DESCRIPTION OF THE PREFERRED EMBODIMENT

Figure 1:
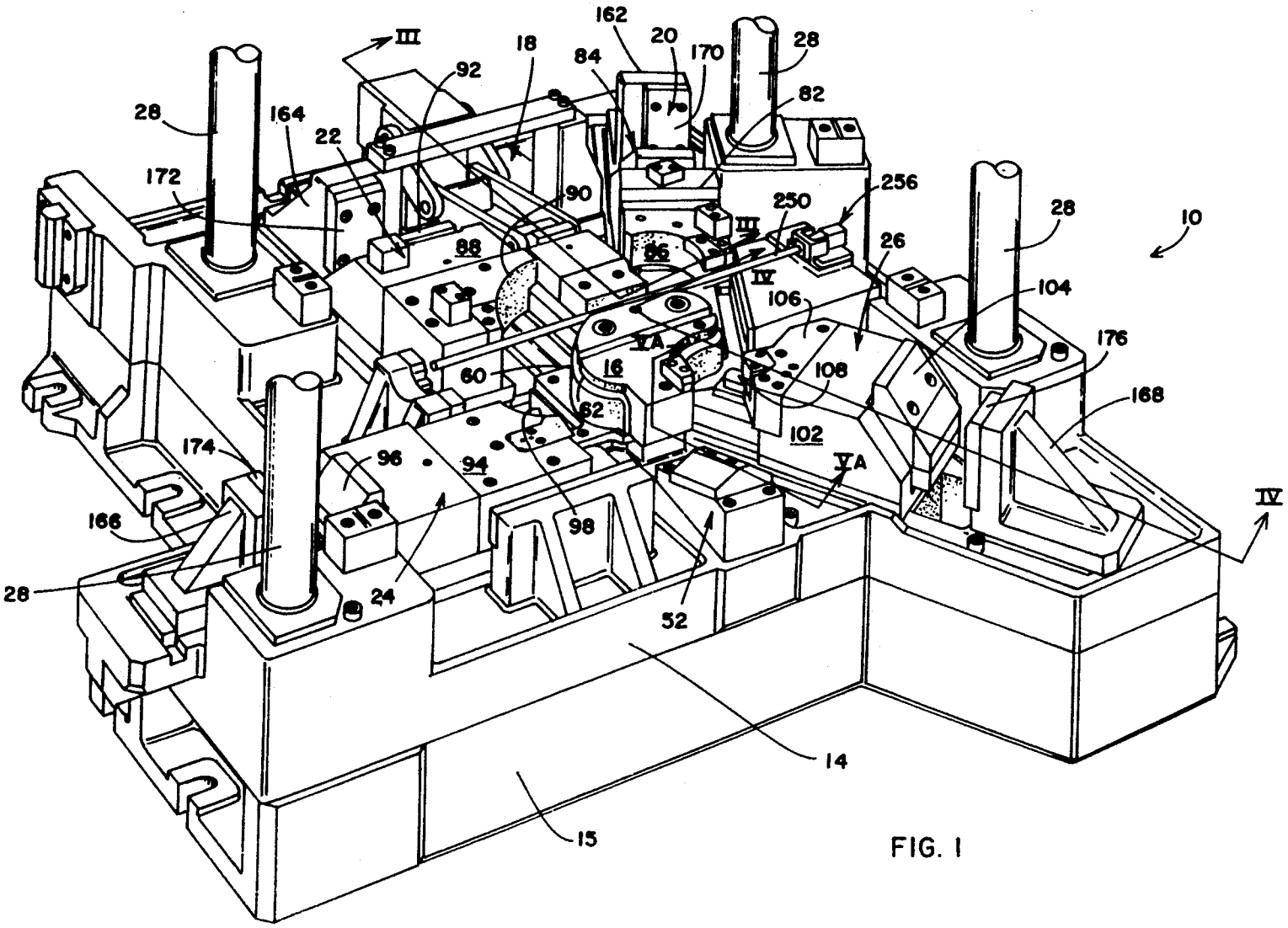
FIG. 1 is a perspective view of the lower half die subassembly of a forming apparatus in accordance with the present invention.
Figure 2:
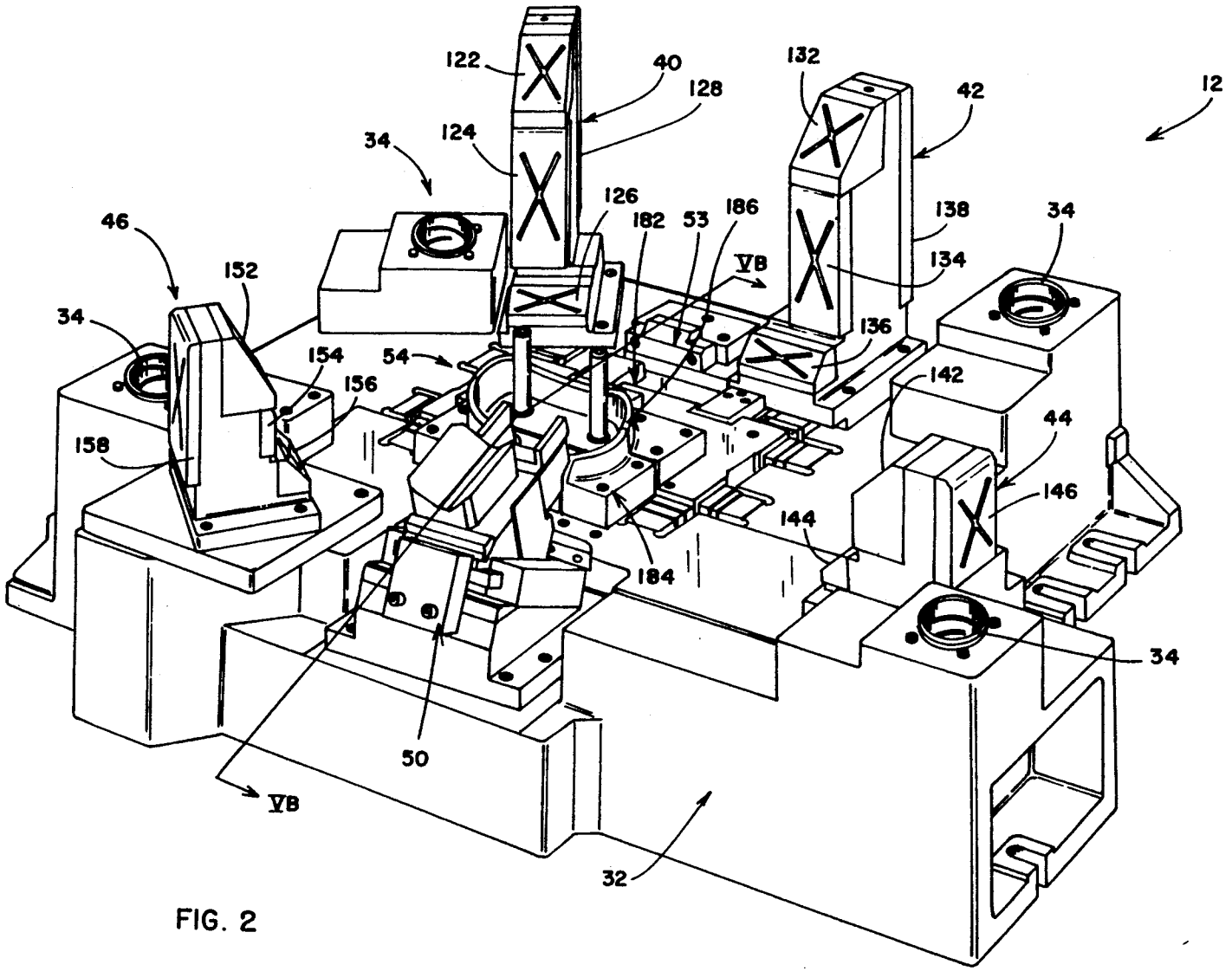
FIG. 2 is a perspective view of the upper half die subassembly of the forming apparatus in accordance with the present invention.

A tube forming apparatus in accordance with the present invention is illustrated in FIGS. 1 and 2. As shown therein, the apparatus includes a lower half die subassembly 10 and an upper half die subassembly 12. In use, subassemblies 10 and 12 are positioned in juxtaposed relationship in a conventional press for movement towards and away from each other. Subassembly 10 includes a lower half die shoe 14 and a riser 15. Shoe 14 supports a plurality of forming components. A forming post 16, a clamp subassembly 18 and slide subassemblies 20, 22, 24 and 26 are positioned on and secured to die shoe 14 . A plurality of vertically extending leader pins 28 are also mounted on the lower half die shoe.

As shown in FIG. 2, upper half die shoe assembly 12 includes an upper half die shoe 32 supporting a plurality of bushings 34 which receive leader pins 28 to position upper assembly 12 with respect to lower assembly 10. A plurality of driver post subassemblies 40, 42, 44 and 46 are secured to die shoe 32. As described in more detail below, the driver posts cooperate with the slide subassemblies 20, 22, 24 and 26. Also mounted on shoe 32 is a slide assembly 50 which cooperates with a driver assembly 52 mounted on lower half die shoe 14. Subassembly 12 further includes a clamp driver 53 and an upper forming steel subassembly 54.

As best seen in FIGS. 1, 3A, 4A and 5A, form post 16 is a configured member defining a ledge or shoulder 60 and a peripheral wall surface 62. Post 16 is shaped to correspond to the desired configuration of the part to be formed by the apparatus.

Figure 3A:
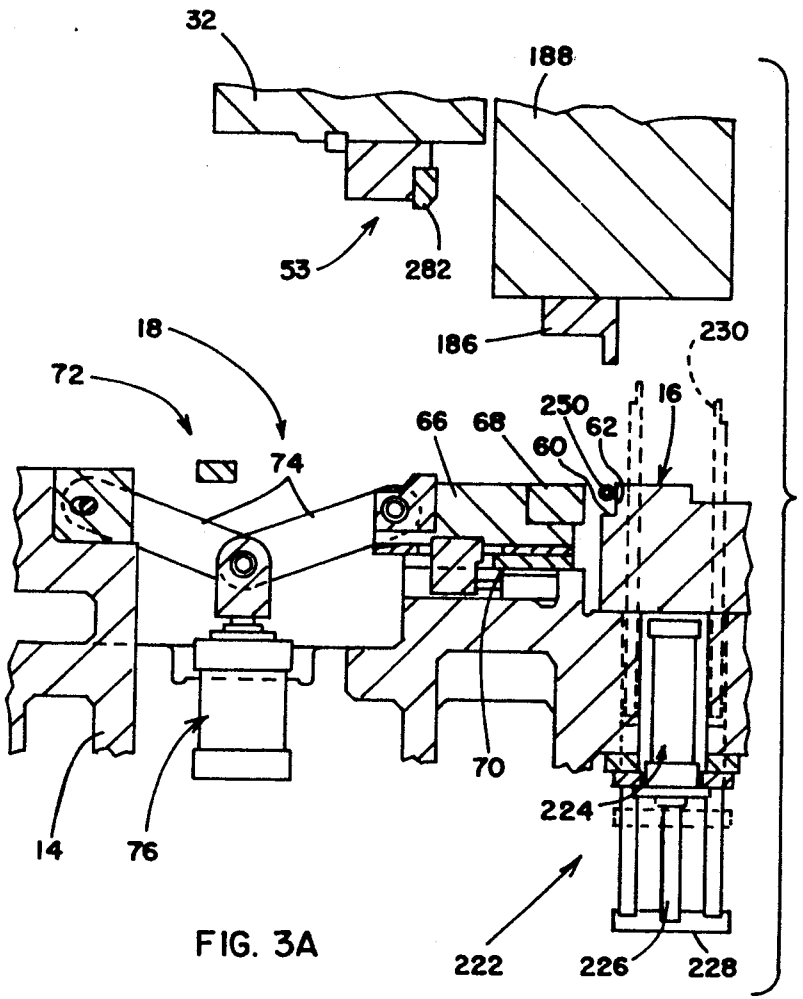
FIGS. 3A-3D are fragmentary, cross-sectional views taken generally along line III-III of FIG. 1 showing the positioning of the upper and lower half die subassemblies and forming components.

Clamp subassembly 18 includes a clamp slide 66 which supports a clamp member 68 (FIG. 3A). Slide 66 is slideably mounted on lower half die shoe 14 by a track subassembly 70. A toggle actuator 72 moves clamp slide 66 towards and away from form post 16. Actuator 72 includes a pair of links 74 and a piston/cylinder actuator 76.

Figure 4A:
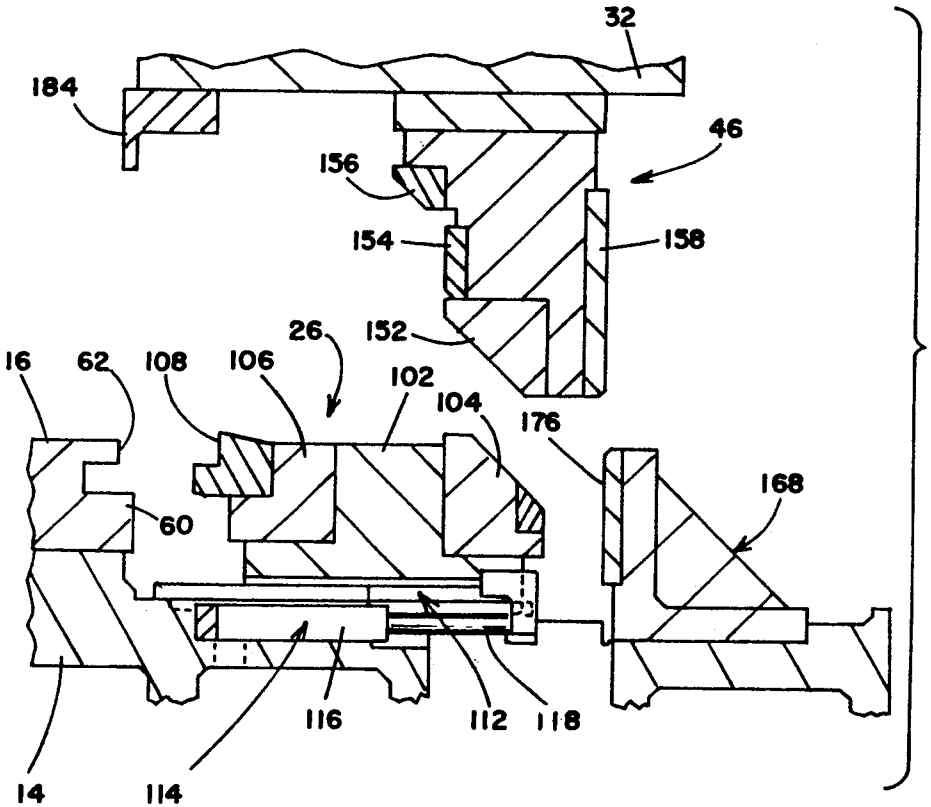
FIGS. 4A-4D are fragmentary, cross-sectional views taken generally along line IV—IV of FIG. 1 and also showing the upper and lower half die subassemblies and forming components.

As seen in FIG. 1, slide subassembly 20 includes a slide block 82 which supports a cam follower member 84 and a configured tool 86. Slide subassembly 22 includes a slide block 88 which supports a configured tool 90 and a cam follower 92. Slide subassembly 24 includes a slide block 94 which supports a cam follower 96 and a configured tool 98. Slide 26 (FIGS. 1 and 4A) includes a block 102 which supports a cam follower 104 and a configured tool 106. A generally L-shaped in cross-section forming tool 108 is secured to tool 106. As seen in FIG. 4A, block 102 is slideably mounted on shoe 14 by a track subassembly 112. Track subassembly 112 further includes a gas return spring 114. Spring 114 includes a cylinder 116 and a rod 118 having an end secured to block 102. Gas spring 114, therefore, will move or resiliently bias slide 102 into a position away from form post 16. Each slide assembly 20, 22 and 24 is mounted on shoe 14 by a track subassembly including a gas return spring.

Driver post subassembly 40 includes a first, angled cam member 122; a front, vertical cam member 124; a second, angled pressure-stress cam member 126 and a rear cam member 128. Cam members 122 and 126 are configured and positioned to engage cam follower 84 on slide subassembly 20 during the forming process.

Driver post subassembly 42 includes a first, angled cam member 132; a vertical cam member 134; a second, angled pressure-stress cam member 136 and a rear cam member 138. Angled cam members 132, 136 cooperate with cam follower 92 on slide subassembly 22.

Driver post subassembly 44 includes a first, angled cam member 142; a second, angled cam member 144 and a rear cam member 146. Cam members 142, 144 engage cam follower 96 of slide subassembly 24.

Driver post subassembly 46 includes a first, angled cam member 152; a vertical cam member 154; a second, angled cam member 156 and a rear cam member 158. Cam members 152, 156 engage and cooperate with cam follower 104 of slide subassembly 26.

A plurality of vertical guides 162, 164, 166 and 168 are mounted on lower die shoe 14. Guide 162 includes a Vertical element 170 which is contacted by cam member 128 of driver post subassembly 40. Guide 164 includes a vertical element 172 which cooperates with cam member 138. Guide 166 includes a vertical element 174 which cooperates with cam member 146. Guide 168 includes a vertical element 176 which cooperates with cam member 158 of driver post subassembly 46. The cooperation between element 176 and member 158 is illustrated, for example, in FIGS. 4A and 4. As should be apparent, downward movement of die shoe 32 towards die shoe 14 causes the cam members on the driver post subassemblies to engage the respective cam followers and shift the slides towards form post 16.

Figure 5A:
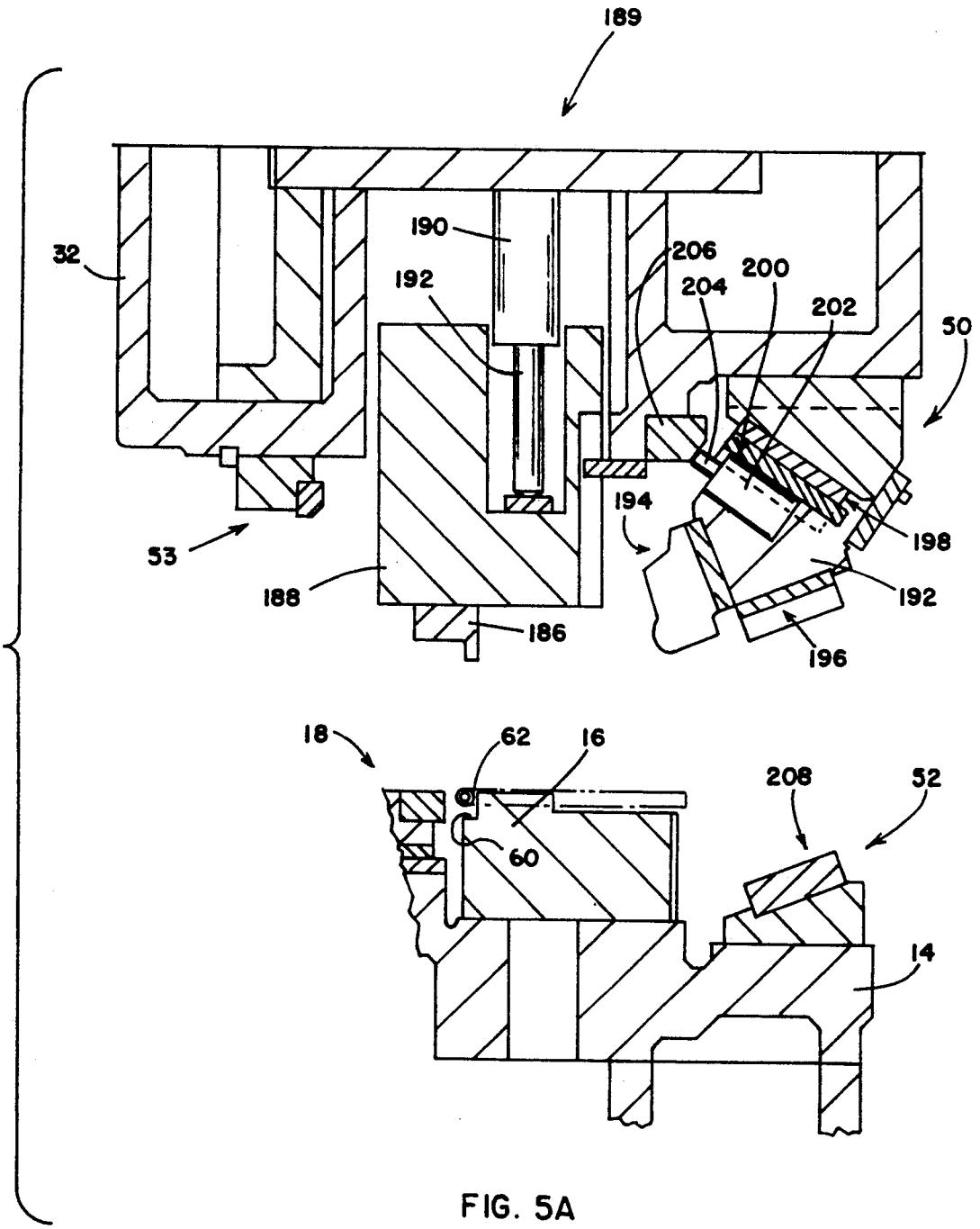
FIGS. 5A-5C are fragmentary, cross-sectional views taken generally along lines Va—Va and Vb—Vb of FIGS. 1 and 2.
Figure 5B:
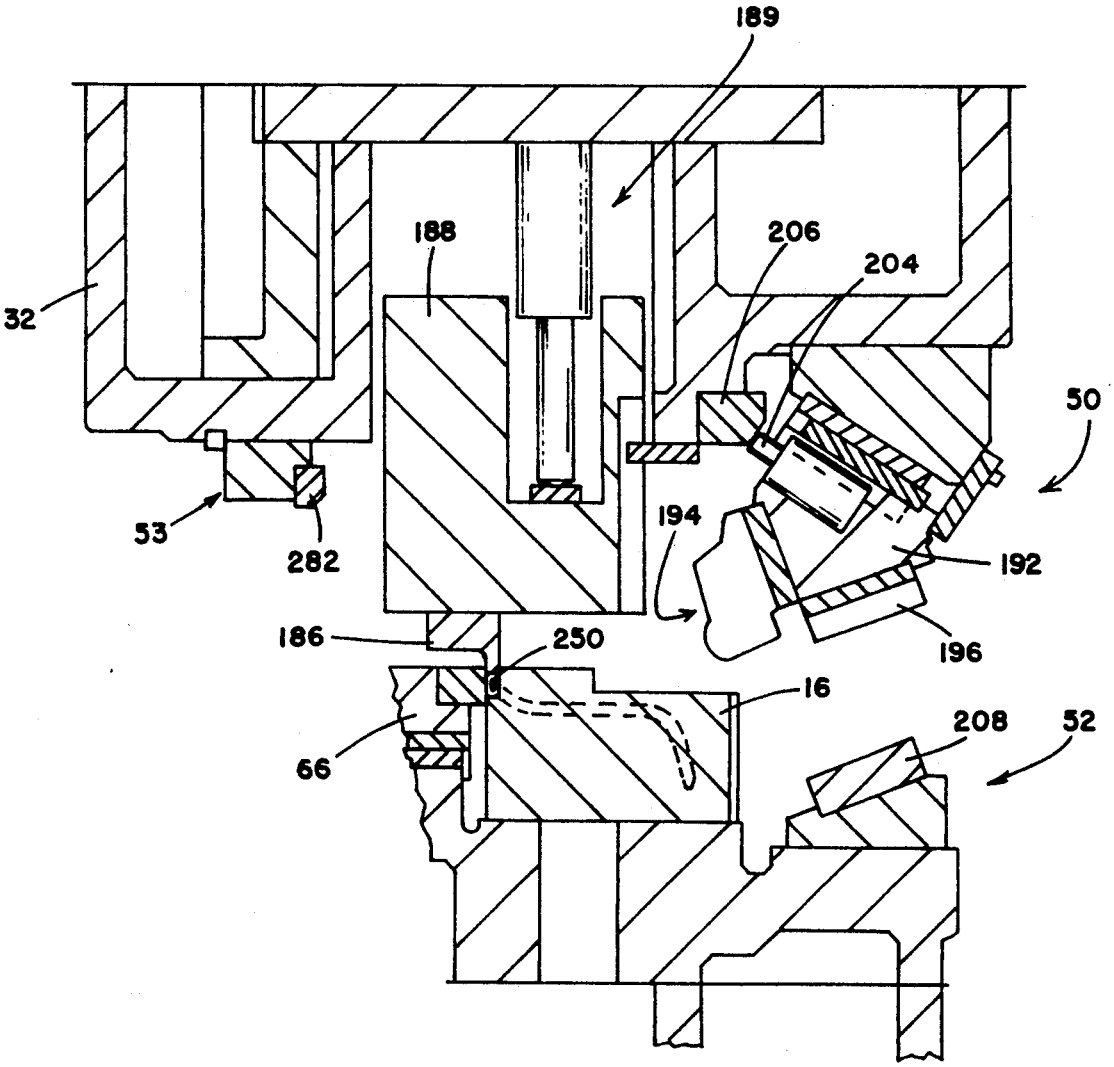

Forming steel or member subassembly 54 includes a first, moveable subassembly 182 and a second subassembly 184 on shoe 32 (FIGS. 2, 3A and 5A). Subassembly 182 includes a configured forming steel 186 Steel 186 is secured to a subshoe 188. As best seen in FIGS. 3A and 5A, subshoe 188 is slideably mounted on die shoe 32 for vertical movement A gas spring 189 includes a cylinder 190 and a rod 192. Rod 192 contacts subshoe 188. Shoe 188, therefore, moves towards shoe 32 against the resilient bias of gas spring 189.

Slide subassembly 50, as best seen in FIGS. 2 and **5*a*, includes a slide block 192 which supports a configured tool 194 and a cam follower 196. Slide block 192 is mounted on shoe 32 by track subassembly 198. A gas return spring is also supported on slide block 192. Spring 200 includes a cylinder 202 and a rod 204. Rod 204 acts against a stop 206 mounted on upper half die shoe 32. Cam follower cooperates with a complimentary shaped cam member 208 which forms part of driver post subassembly 52**.

The apparatus in accordance with the present invention also includes a part extraction subassembly generally designated 222 in FIG. 3A. Subassembly 222 includes an extraction cylinder actuator 224 having a rod 226. A cross piece 228 supports a plurality of injection pins 230. After completion of the forming cycle, rod 226 is retracted lifting injection pins 230 to remove the part from form post 16.

OPERATION

Figure 6A:
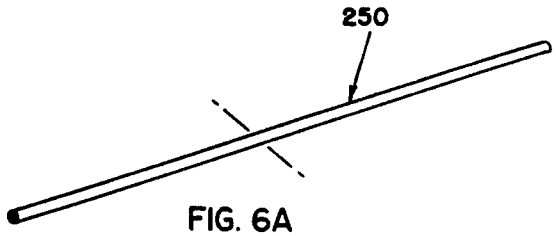
FIGS. 6A-6O illustrate the change of shape of a length of tubing to form the desired part.
Figure 6B:
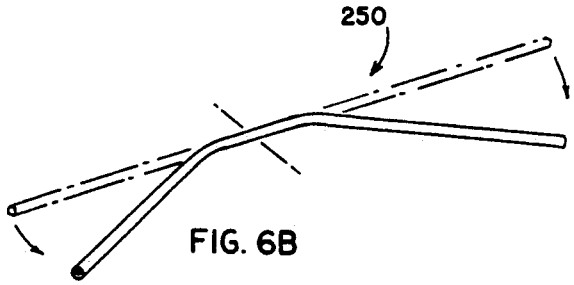
Figure 6C:
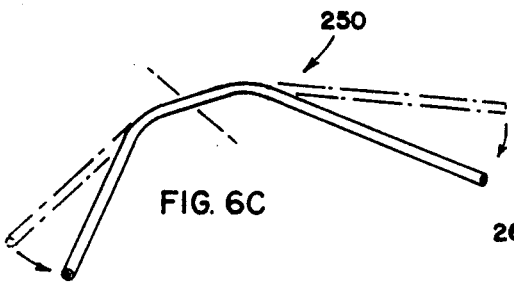
Figure 6D:
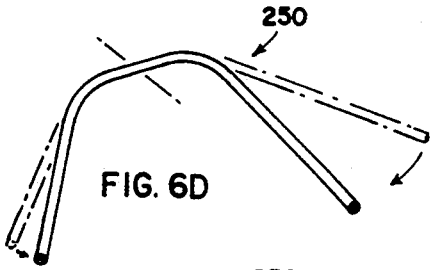
Figure 6E:
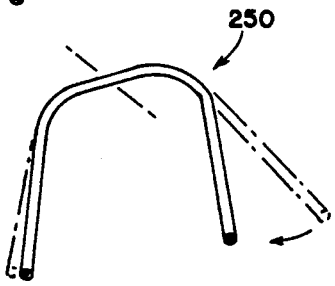
Figure 6F:
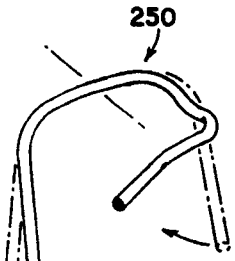
Figure 6G:
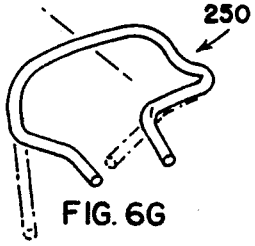
Figure 6H:
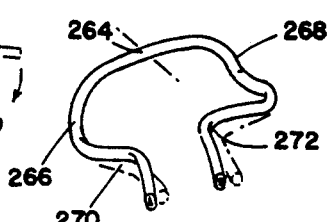
Figure 6I:
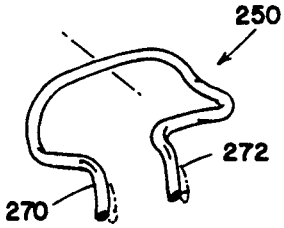
Figure 6J:
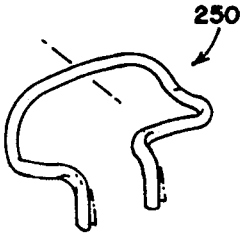
Figure 6K:
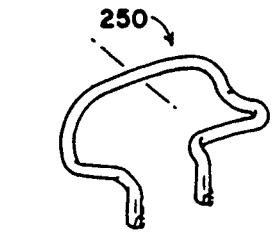
Figure 6L:
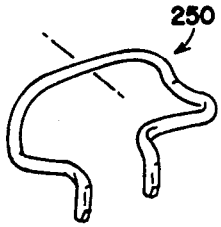
Figure 6M:
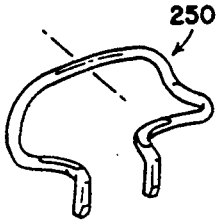
Figure 6N:
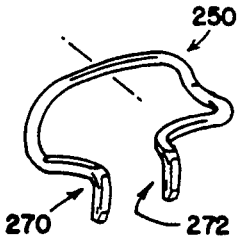
Figure 6O:
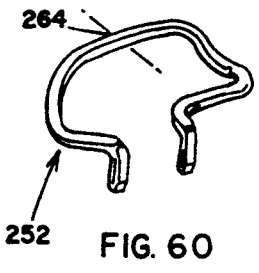
Figure 7:
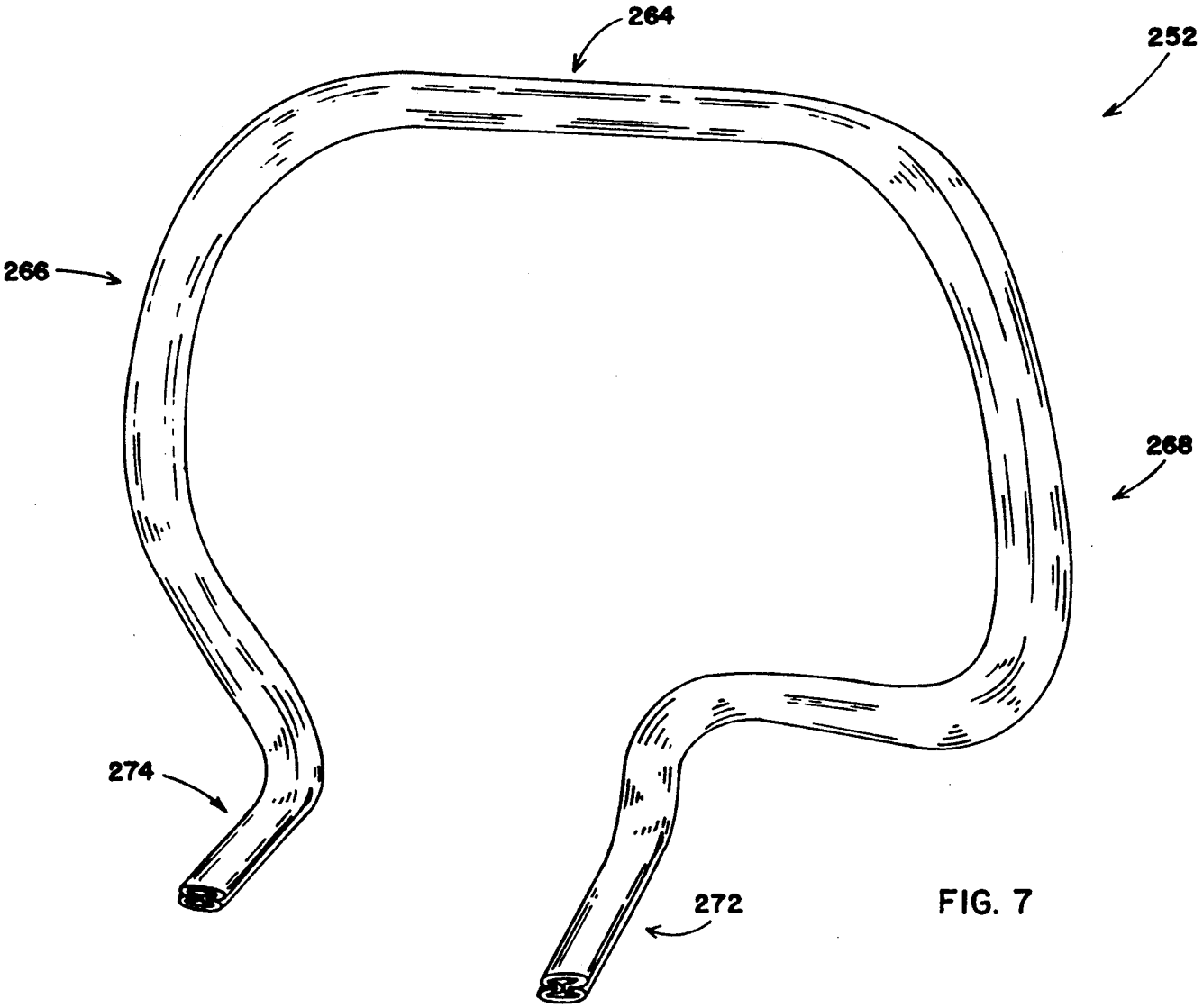
FIG. 7 is a perspective view of a chair arm formed in accordance with the present invention.

The apparatus shown in the drawings progressively and continuously bends and shapes a straight length of round tube 250 as illustrated in FIGS. 6A–6O to form a configured chair arm 252 having a three-dimensional shape. The arm has an elevational appearance similar to the Greek letter Omega. The tooling, as shown, produces a left hand chair arm as illustrated in FIG. 6O. Complementary mirror image tooling must be provided to form a right hand chair arm as illustrated in FIG. 7.

In use, the lower half and upper half die subassemblies are positioned within a suitable press. Initially, the upper half die subassembly is in a fully open position as illustrated in FIGS. 3A, 4A and 5A. When in this position, a straight, round tube 250 is loaded into the apparatus to the position shown in FIG. 1. Tube 250 engages a limit switch and stop subassembly 256. Limit switch and stop subassembly 256 are part of the press control system. Toggle clamp subassembly 72 is actuated to shift the clamp slide 66 from the position shown in FIG. 3A to the position shown in FIG. 3B. Clamp subassembly 72, therefore, clamps tube 250 against form post 16. Forming steel portion 186 is moved into engagement with an upper surface of tube 250 positioning the tube against shoulder 60 at the clamp member. Tube 250, as shown in FIGS. 1, 3 and 4, is held intermediate its ends by engagement of its outer surface. The ends of the tube are unsupported during the forming process. The inside of the tube is empty and, hence, no support is within the interior of the tube during forming.

Figure 4B:
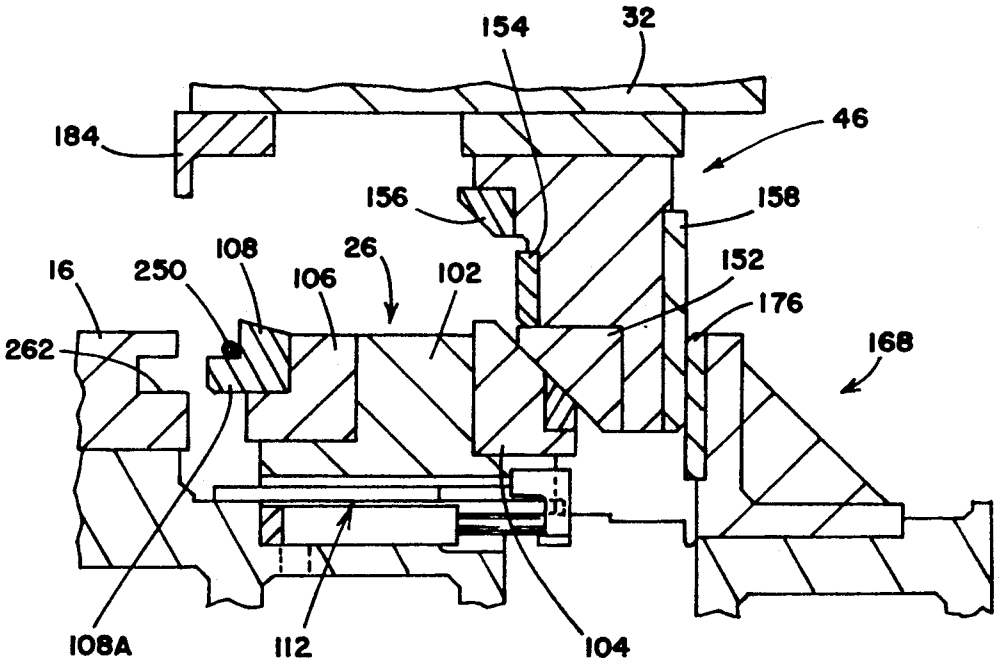
Figure 3B:
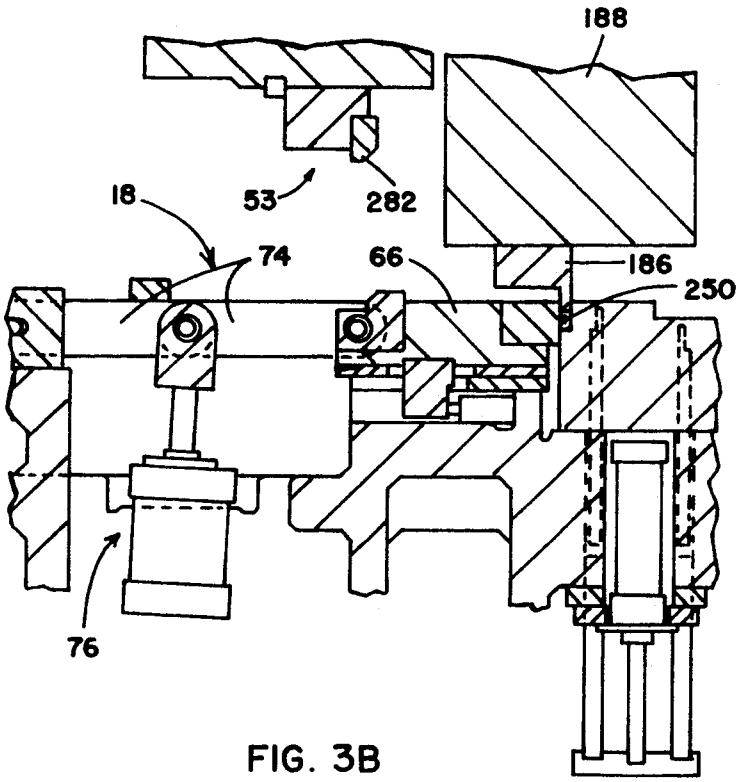
Figure 4C:
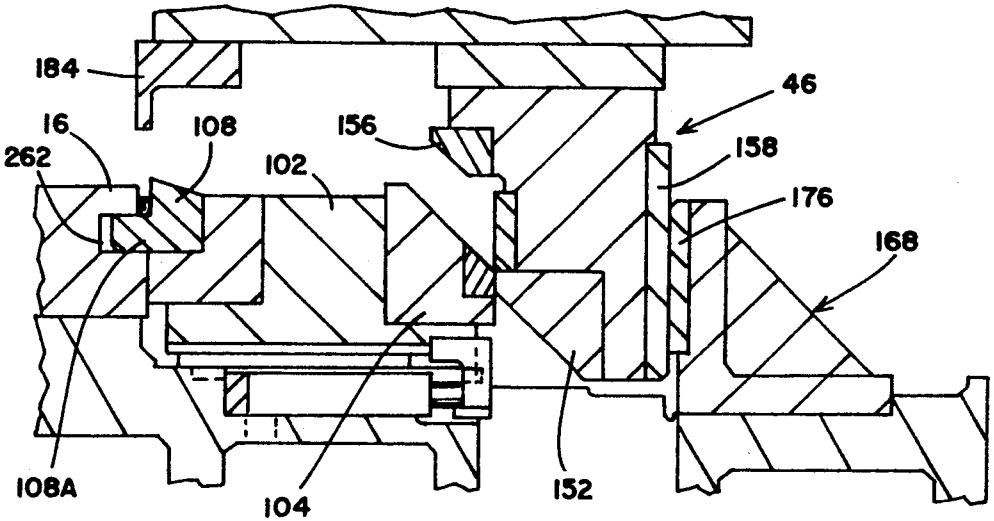
Figure 4D:
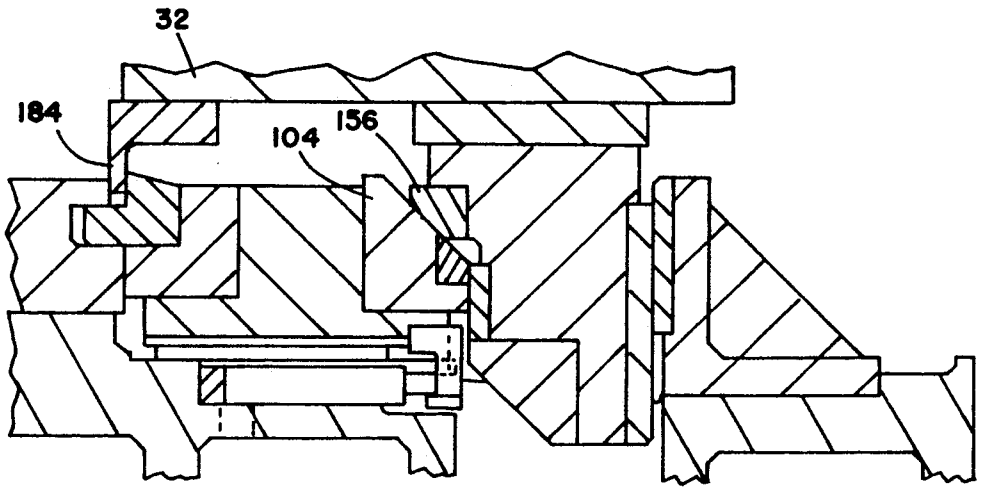

Driver post subassemblies 40, 42 move into engagement with their respective slide subassemblies 20, 22. Cam members 122, 132 engage cam followers 84, 92 moving the slides and their respective tools into engagement with tube 250. The subassemblies are dimensioned and configured to begin bending tube 250 to a generally U-shaped configuration as illustrated in FIGS. 6A–6E. As the slides are positioned as illustrated in FIGS. 3A–3C, FIGS. 4A–4C and FIGS. 5A, 5B, tube 250 is wrapped around the form post to the shape illustrated in FIGS. 6F–6H. As illustrated in FIGS. 4B and 4C, tool 108 has been positioned to support an undersurface of tube 250. A forward snout portion **108*a* of tool 108 moves into a recess or groove 262 formed in post 16. At this point, tube 250 includes a generally straight base portion 264, sides 266, 268 and generally L-shaped portions 270, 272**.

Figure 3C:
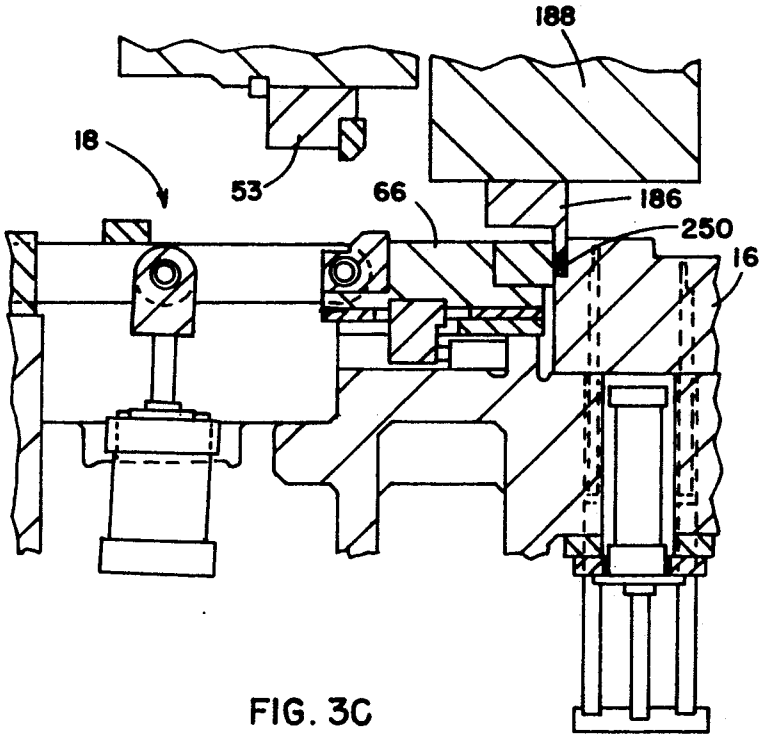
Figure 3D:
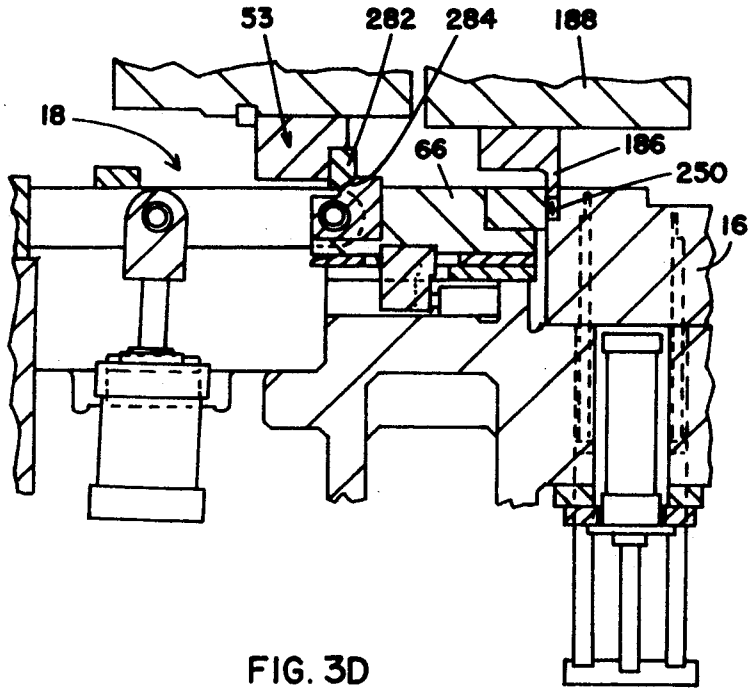
Figure 5C:
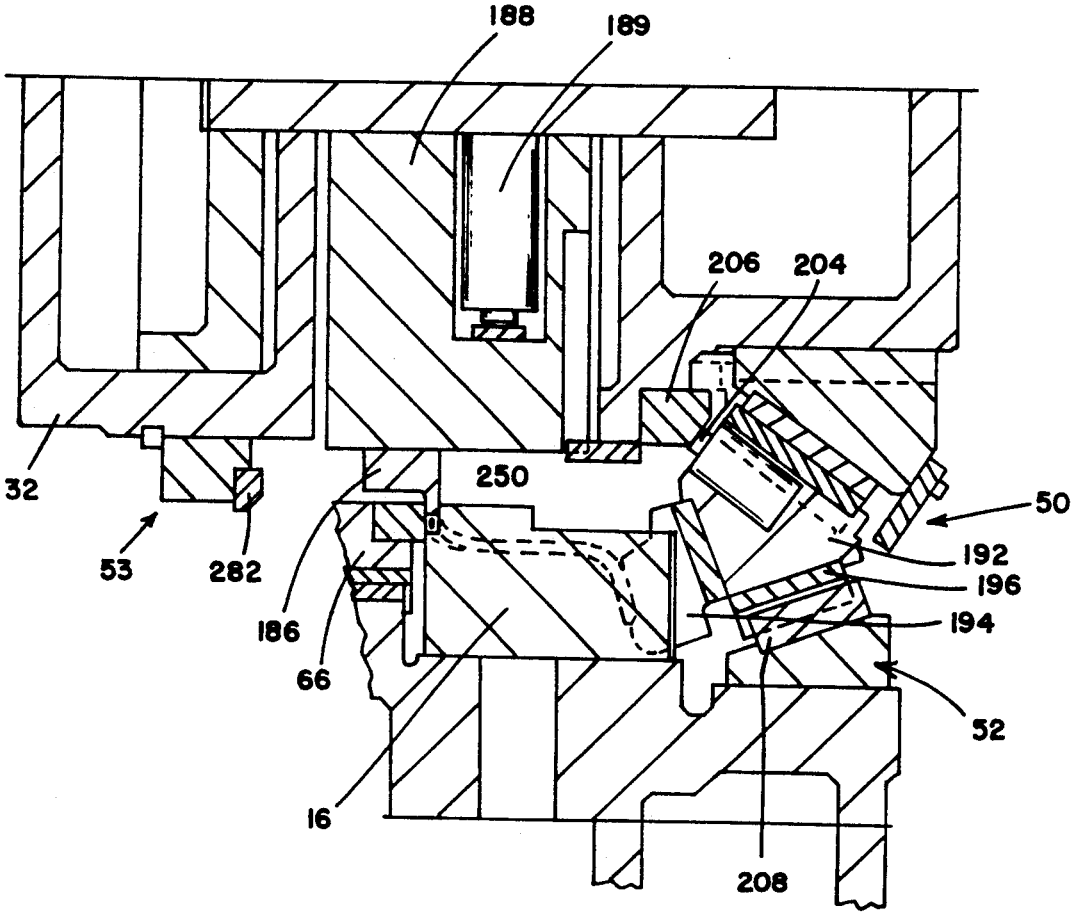

As the upper half die subassembly moves to the position illustrated in FIG. 5C, slide subassembly 50 is shifted towards form post 16 by driver post subassembly 52 Forming die or tooling 194 engages end portions 270, 272 of the tube and drives or bends these portions of the tube into a three-dimensional configuration and downwardly with respect to the remaining portions of the tube, as illustrated in FIGS. 6I–6N. End portions 270, 272 now define attachment tabs for the arm. As upper assembly 12 continues downwardly, a cam 282 on driver post 53 engages a follower surface 284 on clamp slide 66 as shown in FIG. 3D. Second cam member 156 of slide assembly 46 engages cam follower 104. Simultaneously, second, pressure-stress cam members 126, 136 and 156 engage the cam followers of their respective slide subassemblies. The cross-section of the tubing is changed from a generally circular cross-sectional configuration towards a rectangular shape as illustrated in FIG. 6O and FIG. 7. Forming steels 184, 186 fully engage the surface of the tube. The downwardly directed force of the forming steels 184, 186 and the shifting of the slides applies a pressure to the tubing sufficient to stress the tubing and change the cross-sectional configuration in a crimped-like manner to eliminate springback. The tooling squeezes or crimps the tube with a pressure sufficient to set up stresses which counterbalance the surface stresses in the tube.

The apparatus wraps a straight piece of round tubing around a form post, drives the two-dimensional shape of the tubing into a third dimension and completes the required part shape by changing the tube cross-section from round towards rectangular through the implementation of pressure. The forming apparatus could be described as a continuing cycle progressive die. As the process progresses, the forming is achieved by cycling several individual tool functions. As one function is completed, another starts or has already started.

As best seen in FIG. 7, the resulting part does not have a uniform rectangular configuration. The part varies in cross-sectional shape along its length with portions thereof taking on a crimped appearance and a generally oval shape. The pressures applied are sufficient to eliminate springback and provide a stable part configuration. It is presently believed that the initial cross section of the tube should be round. If it is not, a three-dimensional, unbalanced and non-uniform part shape is extremely difficult to achieve due to column strengths in the tube cross section.

After the upper half die subassembly reaches its bottom position, the control system retracts or opens the shoes and the part ejection subassembly 222 is actuated to lift the part off of the form post. In the fabrication of the chair arm, as illustrated in FIG. 7, the part is then removed to a robotic welder and an attachment bracket (not shown) is welded to attachment tab portions 270, 272. Tolerances achievable simplify attachment of the bracket. Minimal welding is necessary and, hence, little or no heat distortion is experienced. The part may then be coated with a suitable plastic such as a polyurethane for aesthetic reasons.

If continuous seam tubing is used, the final configuration of the part is not dependent upon the orientation of the seam weld. Tolerances of +0.023 inches are achieved. The forming sections of the apparatus require no lubrication. Since tubing is used as a base element, the formed part is produced with zero scrap.

The apparatus and method in accordance with the present invention is readily modifiable to produce any of a wide range of configured parts. In the furniture field, for example, the process could be used to form a frame having the structural and functional requirements for all or a majority of different seating. The frame could be placed in different molds and encapsulated with plastic which would generate the feel and cosmetic surface desired by the chair designer. The final shape of the part is only dependent upon the configuration of the form post, the forming steels and the forming tools which are mounted on the slides. Significant material and cost savings are achieved.

The method and basic apparatus may be used to form tubing having straight and bent shapes. The forming apparatus would bend only portions of the tube and then pressure stress those portions to achieve the desired shape. The entire length of the tube need not be bent.

Those of ordinary skill in the art may envision various modifications to the invention based upon the above description. The above description should, therefore, be considered as only that of the preferred embodiment. The true spirit and scope of the present invention may be determined by reference to the appended claims.

The embodiments of the invention in which an exclusive property or privilege is claimed are defined as follows:

1. A method of forming and shaping at least a portion of a length of generally straight tubing into a desired and predetermined curved shape in a continuous operation and without interruption, comprising the steps of:

holding the tubing by engaging the exterior thereof intermediate its ends;

bending at least a portion of a length of tubing continuously without interior support and without supporting the ends of the tubing to achieve the desired and predetermined curved shape;

holding the position of the tubing in said predetermined shape; and changing the cross-section of the tubing along said at least a portion of its length without interior support into a non-uniform configuration which varies along the length of the tubing sufficiently to eliminate springback substantially and provide a stable part with shape retention by applying pressure to the tubing at a level sufficient to squeeze and clamp the tubing without holding the ends of the tubing to produce stresses which counterbalance surface stresses in the tubing and which stabilize the shape of the tubing in said predetermined curved shaped.

2. A method as defined by claim 1 further including the step of bending the tubing into a three-dimensional shape prior to changing the cross-section.

3. A method as defined in claim 1, wherein the cross-section of the tubing is changed from a generally circular cross-section towards a generally rectangular cross-section.

4. A method as defined in claim 2 wherein the cross-section of the tubing is changed from a generally circular cross-section towards a generally rectangular cross-section.

5. A method as defined in claim 3 further including the step of bending the tubing into a three-dimensional shape.

6. A method as defined in claim 1 wherein said bending step continuously bends the tubing into a three-dimensional shape having a base, curved side portions and attachment tabs.

7. A method as defined in claim 6 wherein said changing step includes the step of changing the tubing from a generally circular cross-section towards a generally rectangular cross-section.

* * * * *

UNITED STATES PATENT AND TRADEMARK OFFICE

CERTIFICATE OF CORRECTION

PATENT NO. : 5,297,415
DATED : March 29, 1994
INVENTOR(S) : John L. Hendricks

It is certified that error appears in the above-indentified patent and that said Letters Patent is hereby corrected as shown below:

On the title page, item [63], and column 1, line 9:

"Jan. 24" should be --July 24--.

Column 5, line 25;

"4A and 4" should be --4A and 4B--.

Signed and Sealed this

Eleventh Day of October, 1994

*Attest:*

*Attesting Officer*

BRUCE LEHMAN

*Commissioner of Patents and Trademarks*